US009575459B2

(12) United States Patent
Lee et al.

(10) Patent No.: US 9,575,459 B2
(45) Date of Patent: Feb. 21, 2017

(54) TONER RECYCLING DEVICE FOR IMAGE FORMING APPARATUS

(71) Applicant: SINDOH CO., LTD., Seoul (KR)

(72) Inventors: Byung Bag Lee, Seoul (KR); Woo Sung Jung, Seoul (KR); Jin Sam Park, Seoul (KR)

(73) Assignee: SINDOH CO., LTD., Seoul (KR)

( * ) Notice: Subject to any disclaimer, the term of this patent is extended or adjusted under 35 U.S.C. 154(b) by 0 days.

(21) Appl. No.: 14/928,090

(22) Filed: Oct. 30, 2015

(65) Prior Publication Data

US 2016/0334752 A1 Nov. 17, 2016

(30) Foreign Application Priority Data

May 13, 2015 (KR) ..... 10-2015-0066578

(51) Int. Cl.
*G03G 21/10* (2006.01)

(52) U.S. Cl.
CPC ..... *G03G 21/105* (2013.01)

(58) Field of Classification Search
None
See application file for complete search history.

(56) References Cited

U.S. PATENT DOCUMENTS 5,950,062 A * 9/1999 Yahata ..... G03G 21/105 399/358
2002/0127031 A1* 9/2002 Arai ..... G03G 21/105 399/253
2015/0139690 A1* 5/2015 Kim ..... G03G 21/10 399/111

FOREIGN PATENT DOCUMENTS

JP 05066659 A * 3/1993
JP 2001-194908 7/2001

* cited by examiner

*Primary Examiner* — David Gray
*Assistant Examiner* — Thomas Giampaolo, II
(74) *Attorney, Agent, or Firm* — Nixon & Vanderhye P.C.

(57) ABSTRACT

Provided is a toner recycling device for an image forming apparatus, including a waste toner conveying screw which conveys waste toner collected out of a surface of a photosensitive drum to one side; a toner recycling means which is connected with the waste toner conveying screw to be rotated by rotation of waste toner conveying screw, filters a foreign substance out of the waste toner conveyed by the waste toner conveying screw, supplies the recycled toner from which the foreign substance is removed toward a developing unit, and discharges the foreign substance filtered out of the waste toner to an outside of a drum unit; and a collecting case which is integrally formed with the drum unit at one side of the drum unit to collect the foreign substance filtered by the toner recycling means, wherein the foreign substance like paper dust contained in the waste toner is filtered, and then the recycled toner is supplied again toward the developing unit, thus it is possible to prevent the quality of a printed image from being degraded.

13 Claims, 5 Drawing Sheets

TONER RECYCLING DEVICE FOR IMAGE FORMING APPARATUS

This application claims priority to KR Patent Application No. 10-2015-0066578 filed 13 May 2015, the entire contents of which is hereby incorporated herein by reference.

TECHNICAL FIELD

The present invention relates to a toner recycling device which filters and discharges a foreign substance like paper dust contained in waste toner used in an image forming apparatus, and recycles toner from which the foreign substance is removed.

BACKGROUND ART

An image forming apparatus such as a copy machine, a printer and a multifunction printer is classified into an ink-jet type, an electro-photographic type and a thermal transfer type according to an image forming method. In the electro-photographic image forming apparatus, an image is formed on a printing medium through a series of processes such as charging, exposing, developing, transferring and fixing.

A conventional electro-photographic image forming apparatus includes a cartridge assembly in which a drum unit and a developing unit are integrally formed, wherein the drum unit has a photosensitive drum, a charging roller, transfer roller so on, and the developing unit accommodates a developer therein and has a developing roller and a supply roller.

Here, the cartridge assembly has the developer comprised of toner and carrier for a printing operation. The developer should be replenished or replaced due to consumption of the toner by the printing operation.

Formerly, the replenishment or replacement of the developer was performed by collecting and discharging a waste developer, i.e., waste toner and waste carrier at the same time and then replenishing a new developer. However, in such a developer replenishing or replacing method, a large amount of the developer is abandoned, and a waste developer receiving part is required separately.

In Japanese Patent Publication No. 1993-66659 (Patent document 1), there is disclosed an image forming apparatus in which the toner is collected and reused in consideration of a conventional developer consumption. Patent document 1 discloses a process cartridge in which a waste toner tank is integrally installed at a photosensitive drum, and a discharging system for collecting the waste toner in the waste toner tank into a developing machine is installed.

Meanwhile, in Japanese Patent Publication No. 2001-194908 (Patent document 2), there is disclosed an image forming apparatus in which the toner is collected and reused, and a supply amount of the carrier is controlled.

However, in case of the patent documents, the collected toner contains a foreign substance or paper dust generated from printing paper, and the paper dust or the foreign substance contained in the waste toner is introduced into the developing machine, while the waste toner is recycled, and has a bad influence on image quality. Therefore, there is a problem in that a life space of a cartridge having a waste toner recycling structure is shortened.

DISCLOSURE

Technical Problem

The present invention is directed to providing a toner recycling device for an image forming apparatus, which is capable of filtering foreign substances like paper dust contained in waste toner, and then supplying the recycled toner to a developing unit side, and thus preventing the quality of a printed image from being degraded.

Technical Solution

One aspect of the present invention provides a toner recycling device for an image forming apparatus, including a waste toner conveying screw which conveys waste toner collected out of a surface of a photosensitive drum to one side; a toner recycling means which is connected with the waste toner conveying screw to be rotated by rotation of waste toner conveying screw, filters a foreign substance out of the waste toner conveyed by the waste toner conveying screw, supplies the recycled toner from which the foreign substance is removed toward a developing unit, and discharges the foreign substance filtered out of the waste toner to an outside of a drum unit; and a collecting case which is integrally formed with the drum unit at one side of the drum unit to collect the foreign substance filtered by the toner recycling means.

The toner recycling means may include a filter member which is passed by the waste toner conveying screw and is connected with the waste toner conveying screw, is integrally rotated with the waste toner conveying screw, and, through a mesh filter formed at an outer circumferential surface thereof, filters the foreign substance of the waste toner conveyed by the waste toner conveying screw; and a discharging member which is passed by the waste toner conveying screw and is connected with the waste toner conveying screw at one side of the filter member, is integrally rotated with the waste toner conveying screw and the filter member, and discharges the foreign substance filtered out the waste toner through a discharging hole formed at an outer circumferential surface thereof.

The filter member may be installed at an inside of the drum unit, and the discharging member may be installed at an inside of the collecting case located at an outside of the drum unit, and the recycled toner from which the foreign substance is filtered by the filter member may be collected in the developing unit, and the foreign substance discharged through the discharging member may be collected in the collecting case.

The discharging member may include at least one or more blades which extend from the outer circumferential surface of the discharging member to an outside thereof, and the blades may be integrally rotated with the discharging member by rotation of the waste toner conveying screw to prevent the foreign substance from being vertically accumulated in the collecting case.

A cleaning brush may be installed at an outside of the filter member to be engaged and rotated with the mesh filter, when the filter member is rotated, and thus to prevent holes of the mesh filter from being clogged.

A guide link may be installed under the filter member to guide the recycled toner, from which the foreign substance is filtered through the filter member, toward the drum unit.

The guide link may be connected with the filter member through a connection hook which surrounds the outer circumferential surface of the filter member, and the connection hook may be connected with a cam-shaped rib provided at the outer circumferential surface of the filter member, and thus the guide link may be moved up and down when the filter member is rotated.

The waste toner conveying screw may be formed so that a pitch and an outer diameter of a portion thereof located at insides of the filter member and the discharging member are larger than those of a portion thereof located at outsides of the filter member and the discharging member.

The collecting case may be divided into an upper space in which the foreign substance discharged through the discharging member is collected, and a lower space in which a waste developer discharged from the developing unit is collected, and the upper space and the lower space may be in communication with each other through a communication hole, and a flooding wall having a predetermined height may be provided around the communication hole, and, when the foreign substance is accumulated to a predetermined height or more in the upper space, the foreign substance may falls down into the lower space through the communication hole.

A saturation detecting sensor located at a lower side of the communication hole may be installed at the lower space of the collecting case, and the saturation detecting sensor may detects the foreign substance falling down through the communication hole, and may determines that the upper space is saturated.

The saturation detecting sensor may be installed at a height which is the same as that of a waste developer discharging port, and may detects the foreign substance falling down from the upper space or the waste developer collected in the lower space, and may determines that the upper space or the lower space of the collecting case is saturated.

Advantageous Effects

According to the present invention, the foreign substances like paper dust contained in waste toner can be filtered, and then the recycled toner can be supplied to the developing unit side, and thus the quality of the printed image can be prevented from being degraded.

Also, according to the present invention, since the waste toner recycling means is configured to filter the foreign substances, while integrally rotated together with the conveying screw, it is possible to realize the toner recycling device having a simple structure at a low cost.

Also, according to the present invention, the waste toner and the waste developer can be collected in one collecting case, and the saturation of the waste toner or the waste developer can be detected using one sensor.

MODES OF THE INVENTION

Figure 1:
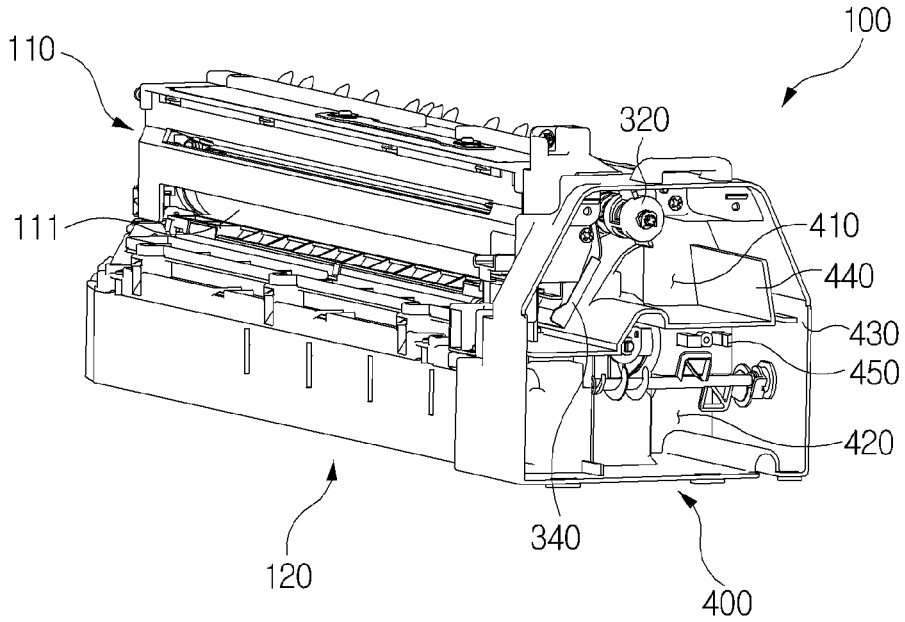
FIG. 1 is a perspective view illustrating a toner recycling device for an image forming apparatus according to the present invention.
Figure 2:
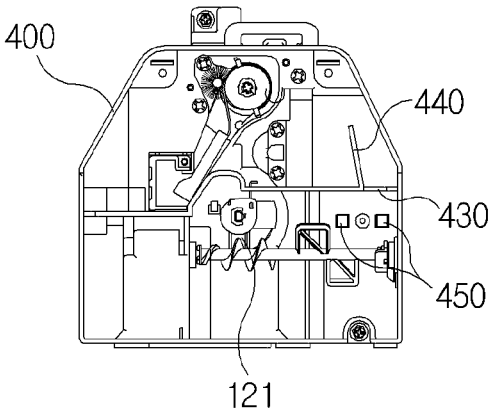
FIG. 2 is a side view of FIG. 1.
Figure 3:
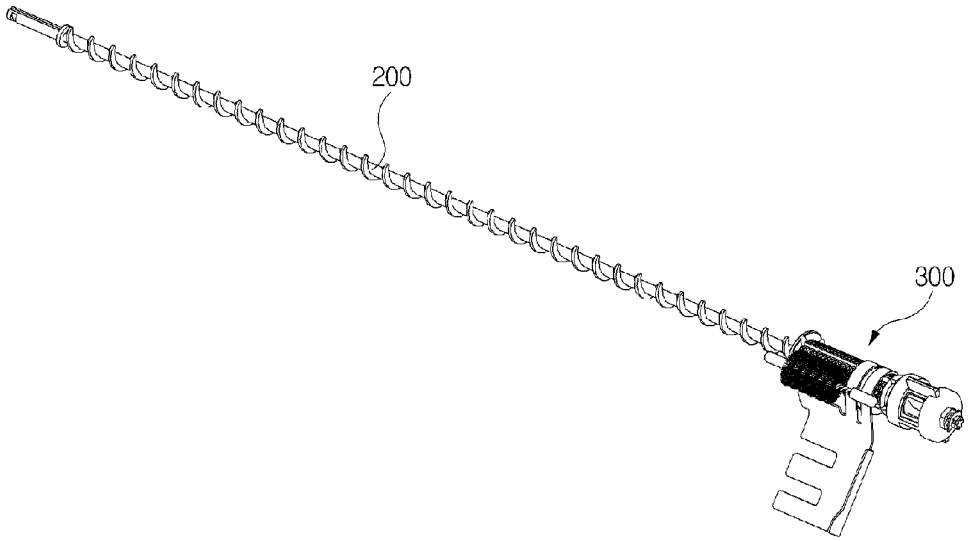
FIG. 3 is a perspective view illustrating a toner recycling means of the toner recycling device for the image forming apparatus according to the present invention.

Referring to FIGS. 1 to 3, a toner recycling device for an image forming apparatus according to the present invention is a device which is installed at an inside of a cartridge assembly 100 of the image forming apparatus to remove a foreign substance, e.g., paper dust or the like, contained in waste toner collected from a drum unit 110. Specifically, the toner recycling device for an image forming apparatus according to the present invention includes a waste toner conveying screw 200, a toner recycling means 300, and a collecting case 400.

The waste toner conveying screw 200 is installed in parallel with a photosensitive drum 111 to convey the waste toner collected out of a surface of the photosensitive drum 111 to one side (e.g., from a left side of FIG. 1 to a right side thereof).

The toner recycling means 300 is connected to one end of the conveying screw 200, and formed to be integrally rotated together with the waste toner conveying screw 200 by rotation of the waste toner conveying screw 200. The toner recycling means 300 serves to filter the foreign substance like the paper dust out of the waste toner conveyed by the waste toner conveying screw 200, to supply the recycled toner from which the foreign substance is removed, to a developing unit side 120, and to discharge the foreign substance like the paper dust filtered out of the waste toner to an outside of the drum unit 110.

The collecting case 400 is formed at one side of the cartridge assembly, specifically, integrally formed with the drum unit 110 at one side of the drum unit 110 and the developing unit 120 to collect the foreign substance like the paper dust filtered by the toner recycling means 300. Also, although not clearly shown in the drawings, the collecting case 400 collects a waste developer discharged by a developer discharging means (not shown) of the developer unit 120.

In the above-described toner recycling device for the image forming apparatus according to the present invention, since the toner recycling means 300 filters the foreign substance like the paper dust contained in the waste toner, and then supplies the recycled toner to the developing unit, it is possible to prevent the quality of a printed image from being degraded.

Here, the toner recycling means 300 includes a filter member 310 and a discharging member 320.

Figure 4:
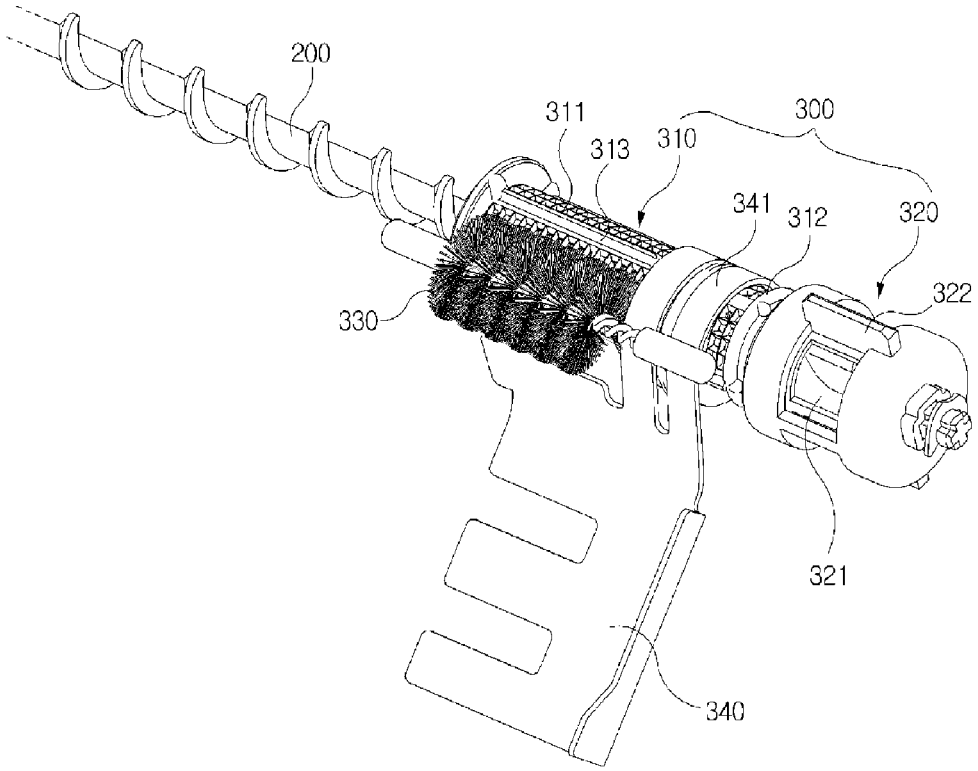
FIG. 4 is an enlarged view of a main portion of FIG. 3.
Figure 5:
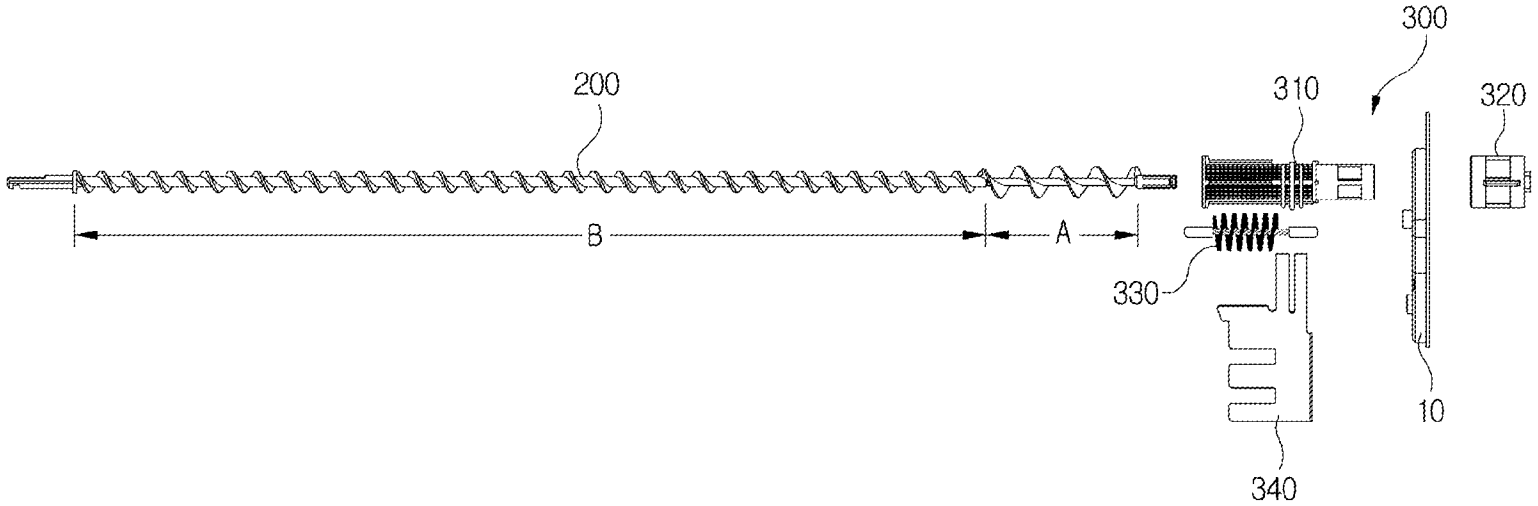
FIG. 5 is an exploded view illustrating the toner recycling means of the toner recycling device for the image forming apparatus according to the present invention.
Figure 6:
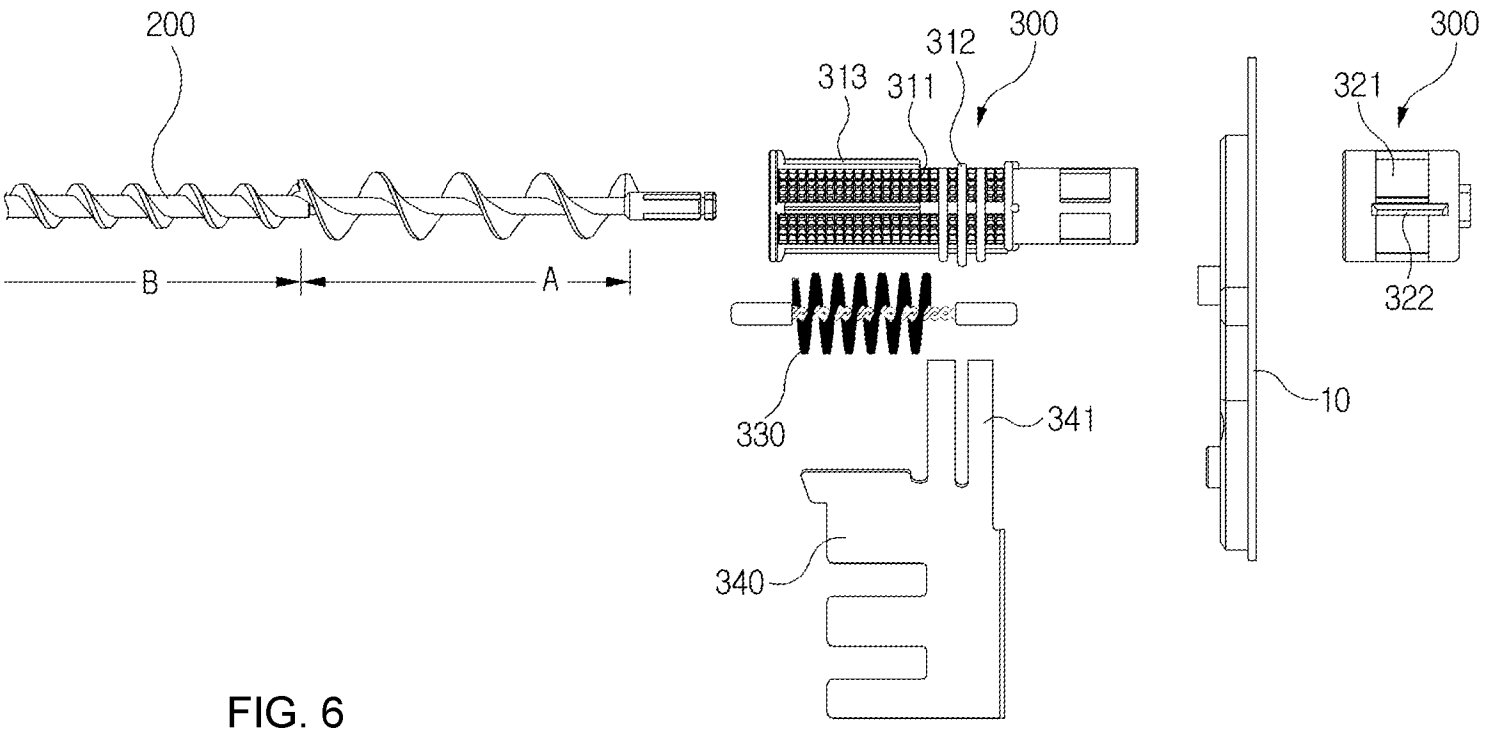
FIG. 6 is an enlarged view of a main portion of FIG. 5.

Referring to FIGS. 4 to 6, the filter member 310 having a cylindrical shape is connected with the waste toner conveying screw 200 since the waste toner conveying screw 200 passes through an inside of the filter member 310, and formed to be integrally rotated with the waste toner conveying screw 200. The filter member 310 has a mesh filter 311 formed at an outer circumferential surface thereof, and filters the foreign substance like the paper dust contained in the waste toner conveyed by the waste toner conveying screw 200, while rotated with the waste toner conveying screw 200. Here, the waste toner containing the foreign substance like the paper dust adheres to each other and forms large clusters, and the recycled toner which does not contain the foreign substance has relatively small particles. Therefore, the recycled toner which does not contain the foreign substance passes through the mesh filter 311 and then is discharged downward by a centrifugal force due to rotation of the filter member 310.

The discharging member 320 is connected with the waste toner conveying screw 200 passing through one side of the filter member 310. The discharging member 320 is integrally rotated with the waste toner conveying screw 200 and the filter member 310. Here, the waste toner containing the foreign substance like the paper dust filtered by the filter member 310 is introduced into an inside of the discharging member 320, and then discharged downward through a plurality of discharging holes 321 formed at an outer circumferential surface of the discharging member 320.

Therefore, the waste toner collected out of the surface of the photosensitive drum 111 is conveyed to one side by the waste toner conveying screw 200, and the recycled toner from which the foreign substance like the paper dust is filtered by the mesh filter 311 of the filter member 310 is supplied. Then, the waste toner containing the foreign substance like the paper dust is introduced into the discharging member 320 by the waste toner conveying screw 200, and discharged downward through the discharging holes 321 of the discharging member 320. Here, the recycled toner passing through the filter member 310 is supplied to the developing unit through a recycled toner supply passage (not shown), and the waste toner containing the foreign substance like the paper dust discharged by the discharging member 320 is discharged to the collecting case 400.

Preferably, the filter member 310 is installed at an inside of the drum unit 110, and the discharging member 320 is installed at an inside of the collecting case 400 located at an outside of the drum unit 110. In FIG. 5, a reference numeral 10 indicates a partition between the drum unit 110 and the collecting case 400. Due to such an arrangement of the toner recycling means 300, the recycled toner from which the foreign substance is filtered through the filter member 310 may be discharged to the drum unit side, and may be collected to the developing unit side through the toner supply passage (not shown), and the waste toner containing the foreign substance like the paper dust discharged through the discharging member 320 may be collected in the collecting case 400.

Meanwhile, referring to FIG. 4, the discharging member 320 includes a plurality of blades 322 which extend from an outer circumferential surface of the discharging member 320 to an outside thereof. The blades 322 are integrally rotated with the discharging member 320 by the rotation of the waste toner conveying screw 200, and serve to even the waste toner containing the foreign substance accumulated in the collecting case 400.

Therefore, the waste toner containing the foreign substance discharged through the discharging member 320 is prevented from being vertically accumulated in the collecting case 400, and thus allowed to be evenly accumulated in the collecting case 400.

Also, a cleaning brush 330 is installed at an outside of the filter member 310. The cleaning brush 330 is installed adjacent to the filter member 310 in a direction parallel with a lengthwise direction of the filter member 310, and also formed to be engaged and rotated with the mesh filter 311, when the filter member 310 is rotated. The cleaning brush 330 is not connected with a separate driving source, but is formed similarly to a driven roller which is rotated by the rotation of the filter member 310, and is in contact with holes of the mesh filter 311, when the filter member 310 is rotated, and thus serves to prevent the holes of the mesh filter 311 from being clogged. Meanwhile, subsidiary ribs 313 for assisting in rotation of the cleaning brush 330 may be disposed at an outer circumferential surface of the filter member 310 with being spaced from each other in a circumferential direction of the filter member 310.

Additionally, a guide link 340 may be installed under the filter member 310. The guide link 340 is a plate-shaped member which extends from the filter member 310 toward the drum unit to guide the recycled toner from which the foreign substance is filtered by the mesh filter 311 of the filter member 310 toward the drum unit.

Here, the guide link 340 is connected with the filter member 310 by a connection hook 341 which surrounds the outer circumferential surface of the filter member 310. A plurality of cam-shaped ribs 312 disposed with being spaced from each other in the lengthwise direction of the filter member 310 are provided at the outer circumferential surface of the filter member 310. Also, the connection hook 341 of the guide link 340 is connected with the filter member 310 to surround the cam-shaped ribs 312, and thus connects the guide link 340 with the filter member 310.

Due to such a connection structure of the filter member 310 with the guide link 340, the guide link 340 is moved up and down by the cam-shaped ribs 312, when the filter member 310 is rotated, and thus the recycled toner discharged to the guide link 340 may not be accumulated on the guide link 340, but may be smoothly moved toward the drum unit.

Meanwhile, the waste toner conveying screw 200 is formed so that a pitch and an outer diameter of a portion thereof located at insides of the filter member 310 and the discharging member 320 are larger than those of a portion thereof located at outsides of the filter member 310 and the discharging member 320. Referring to FIGS. 5 and 6, it may be confirmed that the pitch and the outer diameter of a portion A of the waste toner conveying screw 200 located at the insides of the filter member 310 and the discharging member 320 are larger than those of a portion B thereof located the outsides of the filter member 310 and the discharging member 320.

Due to such difference of the pitches and the outer diameters of the waste toner conveying screw 200, the waste toner may be smoothly conveyed from a left side to a right side, to the filter member 310 and the discharging member 320, based on a conveying direction of the waste toner (from the left side to the right side).

Referring to FIG. 1 again, the collecting case 400 is divided into an upper space 410 and a lower space 420. The upper space 410 is a space in which the waste toner containing the foreign substance discharged through the discharging member 320 is collected, and the lower space 420 is a space in which the waste developer discharged from a waste developer discharging port 121 of the developing unit is collected. The upper space 410 and the lower space 420 are in communication with each other through a communication hole 430 provided at one side wall 430 of the collecting case 400, and a flooding wall 440 having a predetermined height is provided around the communication hole 430.

Due to the collecting case 400 having the above-described structure, when the waste toner containing the foreign substance collected in the upper space 410 is accumulated to a predetermined height or more, i.e., the height or more of the flooding wall 440, the waste toner falls down into the lower space 420 of the collecting case 400 through the communication hole 430.

A saturation detecting sensor 450 located at a lower side of the communication hole 430 is installed at the lower space 420 of the collecting case 400. The saturation detecting sensor 450 may be a photo sensor which detects the waste toner containing the foreign substance and falling down through the communication hole 430. When the saturation detecting sensor 450 detects the waste toner falling down through the communication hole 430, a control part (not shown) of the image forming apparatus determines that the upper space 410 is saturated, and reports it to a user, allowing the collecting case 400 to be replaced.

Preferably, the saturation detecting sensor 450 is installed at a height similar to or substantially the same as that of the waste developer discharging port 121 provided at the lower space 420 of the collecting case 400. The saturation detecting sensor 450 detects the waste toner containing the foreign substance and falling down from the upper space 410 of the collecting case 400, or the waste developer collected in the lower space 420 and accumulated to an installation height of the saturation detecting sensor 450. Therefore, a saturation state in the upper space 410 and the lower space 420 of the collecting case 400 may be detected by using one saturation detecting sensor 450.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A toner recycling device for an image forming apparatus, comprising:

a waste toner conveying screw which conveys waste toner collected from a surface of a photosensitive drum to one side;

a toner recycling means which is connected with the waste toner conveying screw to be rotated by rotation of the waste toner conveying screw, filters a foreign substance out of the waste toner conveyed by the waste toner conveying screw, supplies the recycled toner from which the foreign substance is removed toward a developing unit, and discharges the foreign substance filtered out of the waste toner to an outside of a drum unit; and a collecting case which is integrally formed with the drum unit at one side of the drum unit to collect the foreign substance filtered by the toner recycling means;

wherein the toner recycling means comprises a filter member, through which the waste toner conveying screw passes, is connected with the waste toner conveying screw, is integrally rotated with the waste toner conveying screw, and, through a mesh filter formed at an outer circumferential surface thereof, filters the foreign substance of the waste toner conveyed by the waste toner conveying screw; and a discharging member, through which the waste toner conveying screw passes, is connected with the waste toner conveying screw at one side of the filter member, is integrally rotated with the waste toner conveying screw and the filter member, and discharges the foreign substance filtered out of the waste toner through a discharging hole formed at an outer circumferential surface thereof; and the filter member is installed at an inside of the drum unit, and the discharging member is installed at an inside of the collecting case located at an outside of the drum unit, and the recycled toner from which the foreign substance is filtered by the filter member is collected in the developing unit, and the foreign substance discharged through the discharging member is collected in the collecting case.

2. The toner recycling device of claim 1, wherein the discharging member comprises at least one or more blades which extend from the outer circumferential surface of the discharging member to an outside thereof, and the one or more blades are integrally rotated with the discharging member by rotation of the waste toner conveying screw to prevent the foreign substance from being vertically accumulated in the collecting case.

3. The toner recycling device of claim 1, wherein a cleaning brush is installed at an outside of the filter member to be engaged and rotated with the mesh filter, when the filter member is rotated, and thus to prevent holes of the mesh filter from being clogged.

4. The toner recycling device of claim 1, wherein a guide link is installed under the filter member to guide the recycled toner, from which the foreign substance is filtered through the filter member, toward the drum unit.

5. The toner recycling device of claim 4, wherein the guide link is connected with the filter member through a connection hook which surrounds the outer circumferential surface of the filter member, and the connection hook is connected with a cam-shaped rib provided at the outer circumferential surface of the filter member, and thus the guide link is moved up and down when the filter member is rotated.

6. The toner recycling device of claim 1, wherein the waste toner conveying screw is formed so that a pitch and an outer diameter of a portion thereof located inside of the filter member and the discharging member are larger than those of a portion thereof located outside of the filter member and the discharging member.

7. The toner recycling device of claim 1, wherein the collecting case is divided into an upper space in which the foreign substance discharged through the discharging member is collected, and a lower space in which a waste developer discharged from the developing unit is collected, and the upper space and the lower space are in communication with each other through a communication hole, and a flooding wall having a predetermined height is provided around the communication hole, and, when the foreign substance is accumulated to a predetermined height or more in the upper space, the foreign substance falls down into the lower space through the communication hole.

8. The toner recycling device of claim 7, wherein a saturation detecting sensor located at a lower side of the communication hole is installed at the lower space of the collecting case and the saturation detecting sensor detects the foreign substance falling down through the communication hole, and determines that the upper space is saturated.

9. The toner recycling device of claim 8, wherein the saturation detecting sensor is installed at a height which is the same as that of a waste developer discharging port, and detects the foreign substance falling down from the upper space or the waste developer collected in the lower space, and determines that the upper space or the lower space of the collecting case is saturated.

10. The toner recycling device of claim 1, wherein the discharging member comprises at least one or more blades which extend from the outer circumferential surface of the discharging member to an outside thereof, and the blades is integrally rotated with the discharging member by rotation of the waste toner conveying screw to prevent the foreign substance from being vertically accumulated in the collecting case.

11. The toner recycling device of claim 1, wherein a cleaning brush is installed at an outside of the filter member to be engaged and rotated with the mesh filter, when the filter member is rotated, and thus to prevent holes of the mesh filter from being clogged.

12. The toner recycling device of claim 1, wherein a guide link is installed under the filter member to guide the recycled toner, from which the foreign substance is filtered through the filter member, toward the drum unit.

13. The toner recycling device of claim 12, wherein the guide link is connected with the filter member through a connection hook which surrounds the outer circumferential surface of the filter member, and the connection hook is connected with a cam-shaped rib provided at the outer circumferential surface of the filter member, and thus the guide link is moved up and down when the filter member is rotated.

* * * * *